United States Patent [19]

Harase et al.

[11] Patent Number: 4,709,742

[45] Date of Patent: Dec. 1, 1987

[54] METHOD FOR PRODUCING A THIN CASTING OF CR-SERIES STAINLESS STEEL

[75] Inventors: Jiro Harase; Kuniteru Ohta; Tetsurou Takeshita, all of Kitakyushu; Michio Endo, Kawasaki, all of Japan

[73] Assignee: Nippon Steel Corporation, Tokyo, Japan

[21] Appl. No.: 934,108

[22] Filed: Nov. 24, 1986

[30] Foreign Application Priority Data

May 24, 1986 [JP] Japan ..... 61-118390

[51] Int. Cl.[4] ..... C21D 8/02; B22D 11/00

[52] U.S. Cl. ..... 164/76.1; 164/476; 164/477; 148/2; 148/3; 29/527.4; 29/527.7

[58] Field of Search ..... 164/76.1, 476, 477; 148/2, 3; 29/527.4, 527.7

[56] References Cited

U.S. PATENT DOCUMENTS 4,382,828 5/1983 Henych ..... 148/3

FOREIGN PATENT DOCUMENTS 55-97430 7/1980 Japan .

*Primary Examiner*—Kuang Y. Lin

*Attorney, Agent, or Firm*—Wenderoth, Lind & Ponack

[57] ABSTRACT

The Cr-series stainless steel sheet heretofore produced by a method including annealing a hot-rolled strip for decomposing the $\alpha'$-phase or $\gamma$-transformed phase therein, can be produced by omitting this annealing. In the method according to the present invention, a thin casting is cooled from the solidification temperature to the end temperature of the $\gamma$-phase-precipitation at a cooling speed at least equal to the air cooling-speed, thereby avoiding the $\gamma$-phase-precipitation. Then, the precipitation treatment for precipitating the supersaturated C, N, and S, or the heating to the $\alpha+\gamma$ dual phase-temperature region for precipitating the $\gamma$-phase, is carried out.

17 Claims, No Drawings

METHOD FOR PRODUCING A THIN CASTING OF CR-SERIES STAINLESS STEEL

BACKGROUND OF THE INVENTION

1. Field of the Invention

The present invention relates to a method for producing a thin casting of Cr-series stainless steel.

2. Description of the Related Arts

The thin sheet of stainless steel as the product is manufactured as described in Japanese Unexamined Patent Publication No. 55-97430, by forming a continuously cast casting having a sheet thickness of approximately 200 mm, rough rolling or heating the casting to 1200° C., then hot-rolling the casting to form a hot-rolled strip and subjecting the strip to a hot-coil annealing in a bell type annealing furnace.

As described above, since a thick casting is used in the known techniques, a lot of energy must be utilized to obtain the requisite hot-rolled strip. In addition, since the hot-rolled strip is in an $\alpha$-phase in the as-rolled state, the strip must be annealled in a bell type furnace over a long period of time, to decompose the $\alpha$-phase and thus enhance the cold-rollability.

SUMMARY OF THE INVENTION

The essence of the present invention resides in the cast strip forming of the Cr-series stainless steel, wherein the molten steel is continuously cast into thin strip less than 10 mm thick, preferably less than 3 mm thick, and the casting is cooled rapidly, thereby forming a casting having smaller grain size less than 1000 $\mu$m, or more preferably less than 200 $\mu$m in width and then the cast is hot worked to pressure-bond the loose-structure formed by the rapid solidification and cooling and the precipitation treatment of $\gamma$ phase or super saturated C, N, S into nitrides, carbides or carbonitrides is given to improve cold rollability or elongation of the final product.

By using such a casting as the starting material, the high energy and various plants needed for forming a requisite hot-rolled sheets become unnecessary, and even if a step equivalent to hot-coil annealing is omitted, a thin steel sheet having a good cold-rollability and ridging property can be produced.

A first object of the present invention is to provide a technique for producing a thin sheet having an improved formability, particularly a ridging property, using a thin casting as the starting material. In order to improve the ridging property, the colonies (group of crystal grains having adjacent orientation) must be small in size, randomly dispersed, and composed of grains having a relatively small diameter. To attain this object, the crystals of a casting must have a small grain diameter and an increase in the size of the colonies, due to the boundary movement during the cooling process after solidification, must be prevented.

Since the conventional casting has a large thickness of 100 mm or more, it is difficult to control the solidification speed during the casting, and thus it is impossible to reduce the diameter of the crystal grains in the as-cast state. In addition, it is difficult to control the cooling speed of the casting after the casting, due to the large thickness of a casting. This results in boundary movement in a high temperature region and, in turn, an increase in the size of the colonies and the like. A reduction in the size of the colonies by recrystallization therefore becomes necessary in the hot-rolling process.

Contrary to this, the thickness of casting according to the present invention, is limited to 10 mm or less, preferably 3 mm or less, with the result that the solidification speed after casting can be enhanced, reducing the diameter of the crystal grains in the casting, and further, the cooling speed after solidification can be enhanced to thereby reduce the grain size roughly less than 1000 $\mu$m to 50 $\mu$m according to the thickness of the cast or cooling speed. The shape of the grain is either equiaxial or columnar. The width of the column is taken as a grain size in the case of the columnar grain.

A Second object of the present invention is to omit the step equivalent to the hot-coil annealing carried out to enhance the cold-rollability.

For castings having a thickness of approximately 200 mm, when the surfaces thereof are cooled, after casting, by an ordinary method, the $\gamma$-phase precipitation cannot be prevented, since the cooling speed is limited by the thermal conductivity of the casting per se. Contrary to this, when the thickness of the castings is limited to a certain thickness and cooling after solidification is carried out in the $\alpha$-phase region, then the castings can be brought, without the $\gamma$-phase-precipitation, into the region where the $\alpha$-phase+carbides are present. The C, N, S, and the like, which are supersaturated in the $\alpha$-phase as the solid solution in the $\alpha$-phase+carbides-temperature region, must be precipitation treated to convert C, N, S, and the like into carbonitrides, sulfides, and the like. If such a precipitation treatment is not carried out, drawback arise such that the work hardening is severe in the cold-rolling, and that the final products have a low elongation and a high yield point.

To enhance the cold-rollability, instead of the hot-coil annealing for decomposing the $\alpha'$-phase formed from the $\gamma$-phase into $\alpha$+carbide, the precipitation treatment for precipitating C, N, S, and the like out of the supersaturated solid-solution is carried out. This precipitation treatment can be accomplished in a shorter time than the $\alpha' \rightarrow \alpha$+carbide reaction, and can be carried out by an ordinary coiling process, without the need for a special heat treatment process.

When $\gamma$ phase precipitates during the said rapid cooling after casting, the cold-rollabiliy is improved by the above mentioned precipitation treatment. In this case, the precipitation treatment should be controlled considering the balance of the formability (ridging, $\gamma$ value) and cold-rollability.

A third object of the present invention is to improve the cold-workability of Cr-series stainless steel, by imparting hot work to pressure-bond the loose structure caused by the rapid solidification and cooling.

A further object of giving hot work is to promote the recrystallization at a high temperature.

In this case, a draft imparted at 5% or more is effective for pressure-bonding the loose-structure, but a draft of 25% or more, preferably 35% or more, is necessary for promoting the recrystallization.

In the Cr-series stainless steels having the components needed to form the $\alpha+\gamma$ dual phases at a high temperature, represented by SUS 430, the size of the colonies cannot be reduced in the as-cast state if a casting has an ordinary thickness. In order to reduce the size of the colonies of castings having an ordinary thickness, the $\gamma$-phase must be finely dispersed. The present inventors discovered a method of dispersing $\gamma$ phase in the ferrite matrix in this cast strip.

That is, after the solidification is ended, the castings are cooled in the $\alpha$-phase region to prevent the precipitation of the $\gamma$-phase, and subsequently, reheating is carried out to the $\alpha+\gamma$ dual phase region to precipitate the $\gamma$-phase. This method has the following features, as compared with the method for precipitating the $\gamma$-phase in the solidification step. The precipitates, such as Cr carbides, are finely precipitated from the $\alpha$-phase, and then the $\gamma$-phase is precipitated. These precipitates, therefore, become the site of $\gamma$ precipitation. In addition, the precipitation of the $\gamma$-phase occurs from a low temperature, and thus the speed of growth of the $\gamma$-phase is slow, with the result that fine $\gamma$-phases can be precipitated and dispersed at a high density. In this case, the working imparted prior to reheating to the $\alpha+\gamma$ dual phase region increases the precipitation site of the $\gamma$-phases, thereby further attaining an effective fine dispersion of the $\gamma$-phase.

The reasons for limiting the components of the starting material are as follows.

The Cr content must be 8% or more, since the corrosion resistance is impaired at a lower content, and the corrosion resistance is enhanced with an increase in the Cr content. But, if the Cr content is more than 30%, the enhancement effect is decreased, and further the cold-rollability is impaired. The upper limit of the Cr content is therefore 30%, since a higher content is disadvantageous in the light of economy. The C content must be 0.001% or more, since it is difficult to produce a starting material having a lower content than this by the melting method. The ridging property is improved with an increase in the C addition amount, but a C addition of more than 0.5% will impair the cold rollability and r value. Therefore, the upper limit for the C addition is 0.5%.

The r value is enhanced with an increase in the Al addition amount, but the effect of enhancing the r value saturates at an amount exceeding 0.5%. Accordingly, the upper limit for the Al addition is 0.5%, since a higher content is disadvantageous in the light of economy. The lower limit for the Al addition is 0.001%, since the $O_2$ greatly and disadvantageously increases at a lower content.

The ridging property is enhanced with an increase in the N addition content, but blisters and the like are liable to form at an N content of more than 0.5%. Therefore, the upper limit for the N addition content is 0.5%. The r value is advantageously enhanced as the N content becomes lower than 0.004%, but the ordinary melting methods cannot be employed for the production when the N addition content is less than 0.001%. Therefore, the lower limit for the N addition content is 0.001%.

The components of the starting material according to the present invention may contain any elements, provided that the Cr content lies within the range of from 8 to 30%, and further, that the structure at normal temperature is $\alpha$+(carbide). The components according to the present invention therefore include that which has an $\alpha$ single phase at the entire temperature range. Accordingly, it can be easily understood that the principal object of the present invention is achieved with a composition series wherein the $\alpha$ and $\gamma$ dual phases are formed at a high temperature.

The thickness of the castings used in the present invention is not less than 1 mm and not more than 30 mm, preferably not more than 3 mm. A thinner thickness of the castings is most preferable, since as high a cooling as possible is necessary for refining the crystal grains in the as solidified state, and preventing the grain growth of the $\alpha$-phase and precipitation of the $\gamma$-phase in the cooling process after solidification. The productivity when casting the castings having a thickness of less than 1 mm is, however, low and economically disadvantageous. The lower limit for the thickness of the castings is, therefore, 1 mm. In addition, the upper limit for the thickness of the castings is 30 mm, preferably 3 mm, because, if the thickness of the castings exceeds the upper limit, the grain diameter in the as-cast state is very large, the cooling speed cannot be increased by the usual rapid cooling method, and it becomes difficult to prevent the precipitation of the $\gamma$-phase and the grain growth during the cooling process. As can be clearly understood, since the thickness of the castings is 30 mm or less, rough rolling is obviously unnecessary and can be omitted. Furthermore, the finishing hot-rolling can be omitted if the thickness of the castings is 10 mm or less, preferably 5 mm or less.

In the present invention, the cooling speed for the castings until the end temperature of the $\gamma$-phase-precipitation is not slower than cooling by air cooling, preferably not less than 100° C./sec. This cooling speed is intended to prevent the $\gamma$-phase precipitation and the grain growth. When the cooling speed is faster or the same as air cooling, it is not complete but prevents the $\gamma$-phase precipitation. The $\gamma$-phase precipitation can be essentially prevented at the cooling speed of the less than 100° C./sec.

The castings are subjected to the precipitation treatment in a temperature range of from 1000° C. to 700° C. for a period of 10 seconds or more, in order to precipitate C, N, S, and the like, which are supersaturated in the $\alpha$-phase-solid solution, as carbonitrides, sulfides and the like, thereby enhancing the cold-rollability and the elongation of the final product and lowering the yield strength. When the aging temperature exceeds 1000° C., the solubility is too high to effectively cause precipitation, and thus a grain growth occurs and leads to a deterioration of the ridging property. The upper limit for the precipitation-treatment temperature is therefore 1000° C. The lower limit for the precipitation-treatment temperature is 700° C., because, at a temperature lower than this, the precipitation speed is too low to effectively cause precipitation. The holding time is 10 seconds or more, because holding for less than this time is not effective.

Ordinarily, the above described precipitation treatment is attained by coiling castings having a high temperature of 700° C. or more, preferably 800° C. or more.

A complete absence of the $\gamma$-phase precipitated during the cooling process is preferred in the present invention. But, the objects of the present invention can be attained even with the precipitation of the $\gamma$-phase during cooling as the above mentioned treatment can induce $\gamma\}\alpha$+carbides precipitation which improves the cold-rollability.

For improving the ridging property, preferably the grain diameter is reduced in the as-solidified state and the $\gamma$-phase finely dispersed, as described above. When 10% or less of the $\gamma$-phase precipitates during the cooling process after the solidification, and the reheating up to the $\gamma$-phase-precipitation temperature region is then carried out, the already precipitated $\gamma$-phase becomes the precipitation site of the newly precipitating $\gamma$-phase, with the result that the proportion of the $\gamma$-phase precipitating at positions different from those of the already precipitated γ-phase is decreased, and therefore, the effect of the fine dispersion of the γ-phase for attaining an improvement of the ridging property is lessened. Nevertheless, the ridging property improvement effect is expected when 10% or less of the γ-phase, based on the total amount of the γ-phases, precipitates during the cooling process after the solidification.

The object of reheating again to the α+γ dual phase-temperature region of the Cr-series thin castings, which have been cooled from the solidification temperature to the end temperature of γ-phase precipitation while in the α-phase-temperature region, is to finely disperse and precipitate the γ-phase and thus improve the ridging property. It is advantageous during the reheating to hold the α+γ dual phase-temperature region until at least 30% of the γ-phase based on the total amount of γ-phases is precipitated. That is, to attain the improvement of the ridging property, it is desirable to precipitate as much as possible to the γ-phase uniformly and finely. The precipitation of at least 30% of the γ-phase achieves an outstanding improvement of the ridging property.

In addition, the impartment of working prior to the precipitation heat treatment promotes the precipitation of the γ-phase and increases the precipitation sites, thereby refining the γ-phase. In this case, the draft or screw down should be 10% or more, because a draft lower than 10% would neither promote the precipitation nor of the γ-phase-refinement. A higher draft or screw down is, the more effective, but the effects of working saturate at a 90% or more draft or screw down. Of course, provided that the working is carried out before the precipitation of γ-phase, the imparting of the working effect is attained when carried out either directly after solidification or after rapid cooling, and directly before reheating to the γ-phase-region.

Since, in the case of reheating to the α+γ dual phase-temperature region, C, and N, which are supersaturated in the solid solution of the α-phase due to the rapid cooling, move to the γ-phase, the above described precipitation treatment is not necessarily indispensable. The above described precipitation treatment may be carried out subsequent to the reheating to the α+γ dual phase-temperature region. In this case, since the γ→α transformation partially occurs and the amount of solute C, N, and S decreases, it is possible to enhance the cold-rollability and the elongation of the products, and to decrease the yield strength.

The degree of working may be 5% or more, at a temperature of 800° C. or more, to prevent a loose structure, preferably 25% or more, and more preferably, 35% or more.

The thin castings subjected to the working and heat treatment as described above may be subsequently hot-rolled followed by coiling, cold-rolling, and annealled to obtain the thin strips. The cold-rolling and annealing may be carried out directly, without the hot-rolling. It is easily understood that the conditions for cold-rolling and annealing must be determined in accordance with the objective qualities of the thin strips.

EXAMPLES

EXAMPLE 1

Cr steels having the compositions as shown in Table 1 were cast, by a twin roll method, to form 4 mm thick castings and then immediately water-cooled, followed by coiling at 850° C. to form the castings into thin coils. For comparison, coils which were air-cooled after casting to room temperature and then coiled, were produced. The thin castings produced as described above were cold-rolled. In the castings, which were water-cooled directly after casting and coiled at 850° C., an excellent cold-rollability without incurring ear cracks and thickness variation during the cold-rolling was attained. Martensite was formed in the air-cooled castings, and thus the cold-rollability was impaired.

TABLE 1

| Steel Grades | Main Components of Test Materials Components (weight %) C | N | Cr | Fe |
|---|---|---|---|---|
| A | 0.01 | 0.05 | 13.0 | Balance |
| B | 0.02 | 0.01 | 11.8 | Balance |
| C | 0.04 | 0.01 | 12.0 | Balance |

EXAMPLE 2

SUS 430 steel having the composition shown in Table 2 was cast, by a twin roll method, to form 10 mm thick castings and then immediately water-cooled. For comparison, the castings, which after casting were air-cooled to the room temperature, were produced. Also for comparison, 200 mm thick castings were produced by an ordinary method. In the castings which were water-cooled in accordance with the present invention, the γ-phase-precipitation did not occur and the structure had the ferrite single phase. The air-cooled castings and slabs (castings) produced by an ordinary method had the α+α′ dual phase structure. The 10 mm thick thin castings produced as described above were subjected to a 30% screw down, reheated to the α+γ dual phase-temperature region, and then hot-rolled to produce 3 mm thick hot-rolled sheets, and subsequently, cold-rolled and annealled by an ordinary method. In the thin strips undergoing the process of present invention, virtually nor ridging was observed, but in the thin strips subjected to the air-cooling process, the ridging was extremely large.

TABLE 2

| Main Components of Test Material (Weight %) C | Cr | Al | N | Fe |
|---|---|---|---|---|
| 0.05 | 17.0 | 0.12 | 0.01 | balance |

EXAMPLE 3

A 17% Cr steel having the composition as shown in Table 3 was cast to form 7 mm thick thin castings. Before the precipitation of the γ-phase, rolling was imparted to the thin castings to reduce the thickness thereof to 4 mm. Subsequently, the coiling was carried out at 850° C. to form coils. For comparison, a 17% Cr steel having the composition as shown in Table 3 was cast to form 7 mm thick castings, then subjected, after the initiation of the γ-phase-precipitation, to rolling to form 4 mm thick castings. These castings were subsequently cold-rolled and annealled to form thin sheets. The thin sheets undergoing the casting process of the present invention were free of porous defects, exhibited an excellent cold-rollability, and the final products exhibited an $\bar{r}$ value of 1.10 in terms of r value, and a ridging height of 15 μm. Both of these values were considered excellent. In the comparative material, a hard and brittle α′-phase was present prior to the cold-rolling and the cold-rollability degraded, with the result that the ear cracks were generated during the cold-rolling.

TABLE 3

| Main Components of Test Material (Weight %) | | | | |
|---|---|---|---|---|
| C | Cr | Al | N | Fe |
| 0.03 | 17.2 | 0.12 | 0.02 | balance |

EXAMPLE 4

17% Cr steels having the composition as shown in Table 4 were cast to form 15 mm thick castings and then cooled to 800° C., at a cooling speed of 150° C./sec. Subsequently, the reheating to 1100° C., which was in the $\alpha+\gamma$ dual phase-temperature region, was carried out, and then the castings were rolled to obtain the 4 mm thick hot-rolled sheets. The hot-rolled sheets produced as described above were subjected to a known process for producing thin sheets. For comparison, after casting 15 mm thick castings, the castings were allowed to cool in the atmosphere, and upon arriving at a temperature of 1100° C., rolling was carried out to form 4 mm thick hot-rolled sheets. The hot-rolled sheets produced as described above were subjected to a known process for producing thin sheets.

The material, which was cooled at a cooling speed of 150° C./sec, reheated to the $\alpha+\gamma$ dual phase-temperature region, and then rolled according to the present invention, exhibited a better ridging property (10 μm) compared to the comparative material (28 μm).

TABLE 4

| Main Components of Test Materials (Weight %) | | | | |
|---|---|---|---|---|
| C | Cr | Al | N | Fe |
| 0.02 | 16.5 | 0.15 | 0.05 | balance |
| 0.05 | 17.0 | 0.20 | 0.01 | balance |

EXAMPLE 5

17% Cr steel having the composition as shown in Table 5 was cast to form 3 mm thick castings and cooled to 1000° C. at a cooling speed of 100° C./sec, and then coiled at a temperature of 850° C. For comparison, castings which were rapidly cooled to the room temperature were also produced. The material coiled at the temperature of 850° C. was subsequently cold-rolled at 80% and then annealled at 850° C. for 2 minutes to obtain the final product. The product had an excellent ridging height of 10 μm and an r value of 0.8. Contrary to this, the material which was rapidly cooled down to the room temperature as described above, was then subjected to the identical process for obtaining the final product, but ruptures occurred during the cold-rolling and the yield was greatly decreased.

TABLE 5

| Main Components of Test Material (Weight %) | | | | |
|---|---|---|---|---|
| C | Cr | Al | N | Fe |
| 0.05 | 17.0 | 0.15 | 0.01 | balance |

EXAMPLE 6

17% Cr steel having the composition as shown in Table 6 was cast to form 3 mm thick castings, cooled to 1200° C. at a cooling speed of 20° C./sec, and from 1200° C. to 1000° C. at a cooling speed of 100° C./sec, and then coiled at a temperature of 900° C. A temperature-retaining cover was placed on the coil to cool the coil at a speed slower than air cooling. For comparison, samples which were allowed to cool after the casting, were also produced.

The above castings were cold-rolled to obtain a thickness of 0.4 mm, and then finishing annealled at 900° C. for 40 seconds to obtain the final products. The products undergoing the process of the present invention exhibited an excellent ridging height of 17 μm, a total elongation of 27% and a yield strength of 35 kg/mm$^2$. Contrary to this, the product which was allowed to cool to room temperature after the casting, exhibited a poor ridging height of 28 μm, and a total elongation of 18%.

TABLE 6

| Main Components of Test Material (Weight %) | | | | | |
|---|---|---|---|---|---|
| C | Cr | Al | Ti | N | Fe |
| 0.04 | 17.0 | 0.15 | 0.02 | 0.01 | balance |

As is described above, the Cr-series stainless steel sheet having improved cold-rollability and ridging property can be produced while omitting the rough rolling process, finishing rolling process, and hot-coil annealing process. In addition, such large scale installation as continuous hot-strip mill is not necessary and therefore economical effects are considerably great.

We claim:

1. A method for producing a thin casting of Cr-series stainless steel consisting of, by weight %, from 8 to 30% of Cr, from 0.001 to 0.5% of C, from 0.001 to 0.5% of N, and from 0.001 to 0.5% of Al as main components, a balance being essentially iron, a matrix of said Cr-series stainless steel being constituted, on the basis of an equilibrium phase diagram, of an $\alpha$-phase at an entire temperature region, or of an $\alpha$-phase at room temperature and $\alpha+\gamma$ phase at a high temperature region, comprising steps of:

casting a thin casting of said Cr-series stainless steel;

cooling said thin casting from a solidification temperature thereof to an end temperature of a $\gamma$-phase-precipitation at a cooling speed at least equal to an air cooling-speed of said thin casting, and, subsequently subjecting said thin casting to a precipitation treatment in a temperature range of not less than 700° C. and not more than 1000° C. for 10 seconds or more, thereby forming precipitates in the $\alpha$-phase matrix.

2. A method according to claim 1 further comprising a step of subjecting said thin casting to rolling during the cooling after the solidification or after the cooling but before said precipitation treatment.

3. A method according to claim 1 or 2, wherein said precipitation treatment is carried out by coiling the thin strip having a high temperature after the casting.

4. A method according to claim 3, wherein said coiling is carried out at a temperature of 800° C. or more.

5. A method for producing a thin casting of Cr-series stainless steel according to claim 1 or 2, wherein said thin strip has, in an as-cast state, a thickness of from 1 mm to 30 mm.

6. A method for producing a thin casting of Cr-series stainless steel according to claim 2, wherein said rolling is carried out at a screw down of 5% or more.

7. A method for producing a thin casting of Cr-series stainless steel according to claim 6, wherein said rolling is carried out at a screw down of 25% or more.

8. A method for producing a thin casting of Cr-series stainless steel according to claim 1 or 2, wherein said cooling step is carried out at a cooling speed of 100° C./sec or more.

9. A method for producing a thin casting of Cr-series stainless steel consisting of, by weight %, from 8 to 30% of Cr, from 0.001 to 0.5% of C, from 0.001 to 0.5% of N, and from 0.001 to 0.5% of Al as main components, balance being essentially iron, a matrix of said Cr-series stainless steel being constituted, on the basis of an equilibrium phase diagram, of an $\alpha$-phase at room temperature and an $\alpha+\gamma$ phase at a high temperature region, comprising steps of:

casting a thin casting of said Cr-series stainless steel;

cooling said thin casting from a solidification temperature thereof to an end temperature of a $\gamma$-phase-precipitation at a cooling speed at least equal to an air cooling-speed of said thin casting, and, subsequently subjecting said thin casting to a precipitation treatment of a $\gamma$-phase by heating to an $\alpha+\gamma$ dual phase-temperature region.

10. A method according to claim 9 further comprising a step of subjecting said thin casting to rolling during the cooling after the solidification or after the cooling but before said precipitation treatment.

11. A method according to claim 9 or 10, wherein said precipitation treatment is carried out by coiling a thin strip having a high temperature after the casting.

12. A method according to claim 11, wherein said coiling is carried out at a temperature of 800° C. or more.

13. A method for producing a thin casting of Cr-series stainless steel according to claim 9 or 10, wherein said thin strip has, in an as-cast state, a thickness of from 1 mm to 30 mm.

14. A method for producing a thin casting of Cr-series stainless steel according to claim 10, wherein said rolling is carried out at a screw down of 5% or more.

15. A method for producing a thin casting of Cr-series stainless steel according to claim 14, wherein said rolling is carried out at a screw down of 25% or more.

16. A method for producing a thin casting of Cr-series stainless steel according to claim 9 or 10, wherein said cooling step is carried out at a cooling speed of 100° C./sec or more.

17. A method according to claim 9 or 10, wherein subsequent to said precipitation of $\gamma$ phase, said thin casting is subjected to a precipitation treatment in a temperature range of not less than 700° C. and not more than 1000° C. for 10 seconds or more.

* * * * *